United States Patent [19]

Reinert et al.

[11] Patent Number: 4,775,386

[45] Date of Patent: Oct. 4, 1988

[54] PROCESS FOR PHOTOCHEMICAL STABILIZATION OF UNDYED AND DYED POLYAMIDE FIBRE MATERIAL AND BLENDS THEREOF WITH OTHER FIBRES: COPPER COMPLEX AND LIGHT STABILIZER TREATMENT

[75] Inventors: Gerhard Reinert, Allschwil; Kurt Burdeska, Basel, both of Switzerland

[73] Assignee: Ciba-Geigy Corporation, Ardsley, N.Y.

[21] Appl. No.: 42,771

[22] Filed: Apr. 27, 1987

[30] Foreign Application Priority Data

May 5, 1986 [CH] Switzerland ..... 1826/86
Dec. 18, 1986 [CH] Switzerland ..... 5057/86

[51] Int. Cl.[4] ..... D06M 13/34; D06P 1/62; D06P 3/24; D06P 5/02

[52] U.S. Cl. ..... 8/442; 8/115.7; 8/115.58; 8/115.59; 8/490; 8/531; 8/566; 8/568; 8/570; 8/573; 8/584; 8/602; 8/607; 8/668; 8/924

[58] Field of Search ..... 8/442, 490, 570, 573, 8/602, 624, 566, 568, 115.58, 115.59

[56] References Cited

U.S. PATENT DOCUMENTS

| | | | |
|---|---|---|---|
| 3,363,969 | 1/1968 | Brooks | 8/493 |
| 3,630,662 | 12/1971 | Brody | 8/613 |
| 4,383,835 | 5/1983 | Preuss et al. | 8/602 |
| 4,544,372 | 10/1985 | Heise et al. | 8/602 |
| 4,655,785 | 4/1987 | Reinert et al. | 8/442 |
| 4,668,235 | 5/1987 | Evans et al. | 8/115.58 |
| 4,698,064 | 10/1987 | Evans et al. | 8/128 R |
| 4,704,133 | 11/1987 | Reinert et al. | 8/442 |

FOREIGN PATENT DOCUMENTS

| | | |
|---|---|---|
| 112120 | 6/1984 | European Pat. Off. . |
| 165608 | 12/1985 | European Pat. Off. . |
| 252386 | 1/1988 | European Pat. Off. . |
| 51-088795 | 8/1976 | Japan . |
| 56-096965 | 8/1981 | Japan . |
| 1103144 | 2/1968 | United Kingdom . |
| 8603528 | 8/1986 | World Int. Prop. O. . |

OTHER PUBLICATIONS

Textile Chemists & Colorists, vol. 14 (Oct. 1982) 216–221.

American Dyestuff Reporter, Aug. 7, 1961, pp. 21–26.

American Dyestuff Reporter, Feb. 5, 1962, pp. 35–40.

*Primary Examiner*—A. Lionel Clingman

*Attorney, Agent, or Firm*—Edward McC. Roberts; Meredith C. Findlay

[57] ABSTRACT

A process for the photochemical stabilization of undyed and dyed polyamide fibre material or blends thereof with other fibre materials, which comprises treating the fibre material with a mixture of (A) an organic copper complex, (B) a light stabilizer and, if desired, (C) an antioxidant, an agent for carrying out the process and the fibre material treated with the agent are described.

17 Claims, No Drawings

PROCESS FOR PHOTOCHEMICAL STABILIZATION OF UNDYED AND DYED POLYAMIDE FIBRE MATERIAL AND BLENDS THEREOF WITH OTHER FIBRES: COPPER COMPLEX AND LIGHT STABILIZER TREATMENT

The present invention relates to a process for the photochemical stabilization of undyed and dyed polyamide fibre material and blends thereof with other fibres by treatment with organic copper complexes, light stabilizers and antioxidants.

The use of copper salts, for example copper sulfate, for improving the light fastness of dyeings on polyamide fibres with metal complex dyes is generally known; reference is made to the article by I. B. Hanes in ADR 69 (1980), 3, pages 19 and 20. Inorganic or even organic copper salts, however, frequently have the disadvantage that they are absorbed only inadequately and irregularly by the polyamide fibre and must therefore be used in high concentrations in order to obtain the desired effect. Normally, they can be used only as an aftertreatment and in discontinuous processes.

In EP-A 51,188, it is recommended, for improving the light fastness of polyamide dyeings, to treat the polyamide material before, during or after dyeing with a mixture of copper complexes of bisazomethines and light stabilizers.

Such light fastness improvers have, however, an undesired colour of their own and a not quite sufficient resistance to hydrolysis and acids, as correctly stated in EP-A 113,856 by the same applicant.

EP-A 162,811 and Textilveredlung 20 (1985), No. 11, pages 346–357, have disclosed the use of non-dyeing copper complex compounds, which are stable in the dyebath and have affinity to the fibre, for the light stabilization or light/heat stabilization of dyeings on polyamide fibres. The resulting improvements in fastness and properties at present meet the demands made, for example, by the car industry.

It has now been found that a mixture of copper complex compounds, light stabilizers and antioxidants permits a further improvement in fastness and in the properties such as light fastness and tensile strength.

The present invention thus relates to a process for the photochemical stabilization of undyed and dyed polyamide fibre material or mixtures thereof with other fibre materials, which comprises treating the fibre material with a mixture of (A) an organic copper complex, (B) a light stabilizer and, if desired, (C) an antioxidant As component (A) can be mentioned non-dyeing copper complexes of bisazomethines, acylhydrazones, semicarbazones or thiosemicarbazones of aromatic aldehydes or ketones, or oximes. Compounds of this type have an excellent affinity to the polyamide fibre material and, if they contain groups conferring water solubility, they are also readily water-soluble. They are therefore active even in extremely small amounts.

Bisazomethines of aromatic aldehydes or ketones are here understood to mean Schiff bases of aliphatic or aromatic diamines, the aldehydes and ketones having an HO group in the o-position to the formyl or acyl radical. They are bonded to the metal atom via these two HO groups and the two nitrogen atoms in the bisazomethine moiety. Accordingly, these are quadridentate ligands. The ligands can contain one or more sulfo groups which are located in the aldehyde or ketone moiety and/or in the bisazomethine bridge.

The component (A) used is preferably a copper complex of the formula (I)

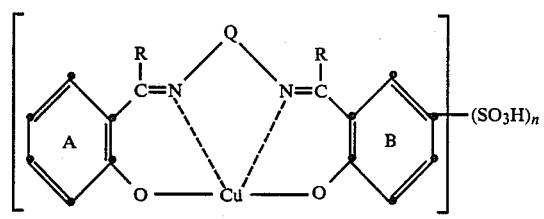

(1)

in which R is hydrogen or a substituted or unsubstituted alkyl or aryl radical, Q is a substituted or unsubstituted alkylene, cycloalkylene or arylene radical and n is 0, 1, 2 or 3.

The benzene rings A and B can also be substituted, and in particular independently of one another.

A substituted or unsubstituted alkyl radical R can preferably be a $C_1$–$C_8$-alkyl radical, especially a $C_1$–$C_4$-alkyl radical, which can be branched or unbranched and can be unsubstituted or substituted, namely by halogen such as fluorine, chlorine or bromine, $C_1$–$C_4$-alkoxy such as methoxy or ethoxy, by a phenyl or carboxy radical, by $C_1$–$C_4$-alkoxycarbonyl, for example the acetyl radical, or by hydroxy or a mono- or di-alkylated amino group. Furthermore, a cyclohexyl radical is also possible, which can likewise be substituted, for example by $C_1$–$C_4$-alkyl or $C_1$–$C_4$-alkoxy.

A substituted or unsubstituted aryl radical R can especially be a phenyl or naphthyl radical which can be substituted by $C_1$–$C_4$-alkyl such as methyl, ethyl, propyl, isopropyl, butyl, isobutyl, sec.-butyl and tert.-butyl, $C_1$–$C_4$-alkoxy such as methoxy, ethoxy, propoxy, isopropoxy, butoxy, isobutoxy, sec.-butoxy and tert.-butoxy, halogen, such as fluorine, chlorine and bromine, $C_2$–$C_5$-alkanoylamino such as acetylamino, propionylamino and butyrylamino, nitro, cyano, sulfo or a mono- or di-alkylated amino group.

An alkylene radical Q is especially a $C_2$–$C_4$-alkylene radical, in particular a $—CH_2—CH_2$ bridge. However, this can also be a $C_2$–$C_8$-alkylene chain interrupted by oxygen or especially by nitrogen, and in particular a $—(CH_2)_3—NH—(CH_2)_3$ bridge.

An arylene radical Q is especially a phenylene radical, in particular an o-phenylene radical. This can also be substituted by $C_1$–$C_4$-alkyl or $C_1$–$C_4$-alkoxy.

A cycloalkylene radical Q is a cycloaliphatic radical having 5–7 carbon atoms, such as cyclopentylene, cyclohexylene or cycloheptylene.

Possible substituents for the benzene rings A and B are: halogen such as fluorine, chlorine or bromine, the cyano or nitro group, alkyl, alkoxy, hydroxyl, hydroxyalkyl, alkoxyalkoxy, alkoxyalkoxyalkoxy, carboxymethoxy, alkylamino, dialkylamino, $—SO_2NH_2$, $—SO_2NHR_o$ or $—SO_2N(R_o)_2$, $R_o$ being alkyl or alkoxyalkyl, and alkyl and alkoxy each being understood as radicals having 1–4 carbon atoms, or a benzene radical formed by radicals in the mutual ortho-positions, together with the carbon atoms to which they are linked.

The sulfo group(s) in the benzene rings A and/or B and/or in the bridge member Q, if the latter is an arylene radical, are preferably in the form of an alkali metal salt, especially as the sodium salt or as an amine salt.

In particular, those copper complexes of the formula (1) are used in the present process in which R is hydrogen, Q is an ethylene or o-phenylene bridge and n is 0 or 2, the two sulfo groups being in the benzene rings A and B, and in turn especially those complexes in which the sulfo groups are each in the p-position to the oxygen.

Amongst the copper complexes of the formula (1) particular importance is attached to the bisazomethine complexes of the formula (2)

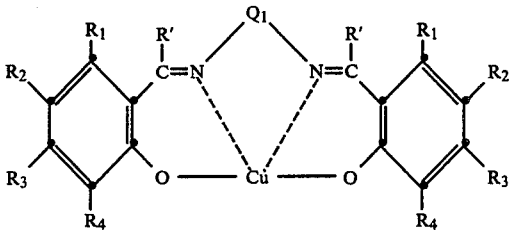

(2)

in which

R' is hydrogen or $C_1$–$C_3$-alkyl, $R_1$, $R_2$, $R_3$ and $R_4$ are each hydrogen, halogen, hydroxy, hydroxyalkyl, alkyl, alkoxy, alkoxyalkoxy, alkoxyalkoxyalkoxy, carboxymethoxy, alkylamino, dialkylamino, $—SO_2NH_2—$, $—SO_2NHR_o$ or $—SO_2N(R_o)_2$, $R_o$ being alkyl or alkoxyalkyl, and alkyl or alkoxy each being understood as groups having 1–4 carbon atoms, or $R_1$ and $R_2$ or $R_2$ and $R_3$ or $R_3$ and $R_4$, together with the carbon atoms to which they are linked, form a benzene radical, and $Q_1$ is a $C_2$–$C_4$-alkylene radical, a $C_2$–$C_8$-alkylene radical interrupted by oxygen or nitrogen, a phenylene radical or a

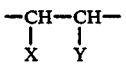

bridge, in which

X and Y are $C_1$–$C_4$-alkyl or an aromatic radical or X and Y, together with the carbon atoms to which they are linked, form a cycloaliphatic radical having 5–7 carbon atoms.

The cycloaliphatic radicals formed by X and Y, together with the carbon atoms to which they are linked, are cyclopentylene, cyclohexylene or cycloheptylene radicals.

Copper complexes of acylhydrazones of aromatic aldehydes and ketones as the component (A) are especially the complexes of the formula (3)

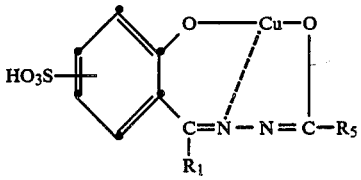

(3)

in which $R_1$ and $R_5$ independently of one another are hydrogen or a substituted or unsubstituted alkyl or aryl radical, and copper complexes of semicarbazones or thiosemicarbazones as the component (A) are especially the complexes of the formula (3a)

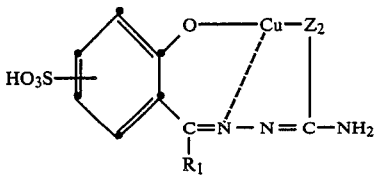

(3a)

in which $R_1$ is as defined under the formula (3) and $Z_2$ is oxygen or sulfur.

An alkyl radical $R_1$ and/or $R_5$ in the formulae (3) and (3a) can be branched or unbranched and has a chain length of preferably 1 to 8 and especially 1 to 4 carbon atoms. Possible substituents are halogen such as fluorine, chlorine or bromine, $C_1$–$C_4$-alkoxy such as methoxy or ethoxy, and also phenyl or carboxy, $C_1$–$C_4$-alkoxycarbonyl, for example acetyl, or hydroxy and mono- or di-alkylamino.

A substituted or unsubstituted aryl radical $R_1$ and/or $R_5$ in the formulae (3) and (3a) can especially be a phenyl or naphthyl radical which can be substituted by $C_1$–$C_4$-alkyl such as methyl, ethyl, propyl, isopropyl, butyl, isobutyl, sec.-butyl and tert.-butyl, $C_1$–$C_4$-alkoxy such as methoxy, ethoxy, propoxy, isopropoxy, butoxy, isobutoxy, sec.-butoxy and tert.-butoxy, halogen such as fluorine, chlorine and bromine, $C_2$–$C_5$-alkanoylamino such as acetylamino, propionylamino and butyrylamino, nitro, cyano, sulfo or a mono- or di-alkylated amino group.

Those complexes of the formula (3) are preferably used in which $R_1$ is hydrogen and $R_5$ is hydrogen, methyl or especially a phenyl radical, and particularly the complexes in which the sulfo group in turn is in the p-position to the oxygen.

The complexes of the formulae (1), (3) and (3a) are preferably used in the neutral form, viz. as an alkali metal salt, in particular the sodium salt, or an amine salt.

Copper complexes of oximes as the component (A) are mainly copper compounds of phenols of the formula (4)

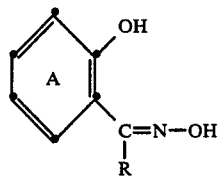

(4)

where R is H, OH, alkyl or cycloalkyl, and in which the ring A can be unsubstituted or further substituted, for example copper compounds of salicylaldoxime and salicylhydroxamic acid.

Suitable alkyl radicals are those having 1 to 4 carbon atoms. Suitable cycloalkyl radicals are cyclohexyl and methylcyclohexyl radicals. Suitable substituents in the ring A are methyl, methoxy or chlorine. However, this ring is preferably unsubstituted.

Preferred copper complexes of the formula (2) are those of the formula (5)

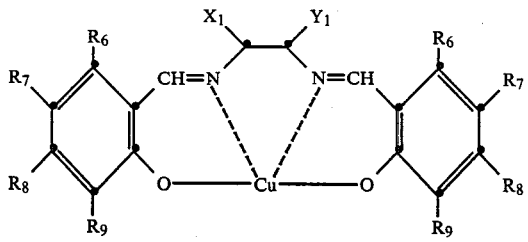

(5)

in which $R_6$, $R_7$, $R_8$ and $R_9$ are each hydrogen, hydroxy, chlorine, bromine, methyl, tert.butyl, methoxy, methoxyethoxy, ethoxyethoxyethoxy or diethylamino and $R_7$ can in addition also be sulfo, $X_1$ is hydrogen, methyl, ethyl, or phenyl and $Y_1$ is hydrogen or $R_6$ and $R_7$ together form a fused benzene radical or $X_1$ and $Y_1$ together form a cyclohexylene radical.

Of particular interest are copper complexes of the formula (6)

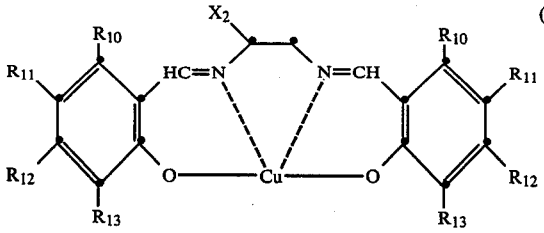

(6)

in which $R_{10}$, $R_{11}$ and $R_{13}$ are each hydrogen, chlorine, bromine, methyl or methoxy and $R_{11}$ can in addition also be sulfo, or $R_{10}$ and $R_{11}$ together form a fused benzene ring, $R_{12}$ is hydrogen or hydroxy and $X_2$ is hydrogen, methyl, ethyl or phenyl.

Those compounds of the formula (6) are of particular interest in which $R_{10}$, $R_{11}$, $R_{12}$, $R_{13}$ and $X_2$ are hydrogen.

As the component (B) all those compounds may be mentioned which are also known as UV absorbers and are described, for example, in Kirk-Othmer 23, 615–627; A. F. Strobel, ADR, 50, (1961), 583–588; 51, (1962) 99–104; R. Gächter and H. Müller, Taschenbuch der Kunststoff-Additive [Handbook of Plastics Additives], Carl Hanser Verlag, Munich, pages 101–198 (1983) and in U.S. Pat. No. 4,511,596.

For example, the following compounds can be used as the component (B):

(a) 2-Hydroxybenzophenones of the formula (7)

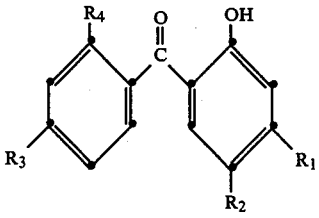

(7)

in which $R_1$ is hydrogen, hydroxy, $C_1$–$C_{14}$-alkoxy or phenoxy, $R_2$ is hydrogen, halogen, $C_1$–$C_4$-alkyl or sulfo, $R_3$ is hydrogen, hydroxy or $C_1$–$C_4$-alkoxy and $R_4$ is hydrogen, hydroxy or carboxy, for example the 4-hydroxy, 4-methoxy, 4-octyloxy, 4-decyloxy, 4-dodecyloxy, 4-methoxy-2'-carboxy, 4,2',4'-trihydroxy, 4,4'-dimethoxy-2'-hydroxy, 4-methoxy-5-sulfo, 2'-hydroxy-4,4'-dimethoxy-5-sulfo, 4-benzyloxy and 5-chloro derivative;

(b) 2-(2'-Hydroxyphenyl)-benzotriazoles of the formula (8)

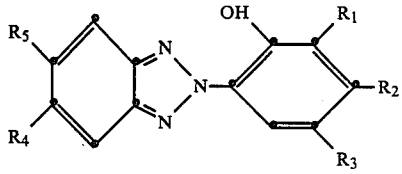

(8)

in which $R_1$ is hydrogen, $C_1$–$C_{12}$-alkyl, chlorine, $C_5$–$C_6$-cycloalkyl, $C_7$–$C_9$-phenylalkyl or sulfo, $R_2$ is hydrogen, $C_1$–$C_4$-alkyl, $C_1$–$C_4$-alkoxy, chlorine, hydroxy or sulfo, $R_3$ is $C_1$–$C_{12}$-alkyl, $C_1$–$C_4$-alkoxy, phenyl, ($C_1$–$C_8$-alkyl)-phenyl, $C_5$–$C_6$-cycloalkyl, $C_2$–$C_9$-alkoxycarbonyl, chlorine, carboxyethyl or $C_7$–$C_9$-phenylalkyl or sulfo, $R_4$ is hydrogen, chlorine, $C_1$–$C_4$-alkyl, $C_1$–$C_4$-alkoxy, $C_2$–$C_9$-alkoxycarbonyl, carboxy or sulfo and $R_5$ is hydrogen or chlorine, wherein the carboxyl and sulfo radicals can also be present as salts, for example alkali metal, alkaline earth metal, ammonium or amine salts. Examples of compounds of the formula (8) are the 5'-methyl, 3',5'-di-tert.-butyl, 5'-tert.-butyl, 5'-(1,1,3,3-tetramethylbutyl), 5-chloro-3',5'-di-tert.-butyl, 5-chloro-3'-tert.butyl-5'-methyl, 3'-sec.butyl-5'-tert.butyl, 4'-octyloxy, 3',5'-di-tert.amyl and 3',5'-bis($\alpha$,$\alpha$-dimethylbenzyl) derivative and the sodium salt of 2-(2'-hydroxy-3'-tert.butyl-5'-methylphenyl)-5-(2H)-benzotriazolesulfonic acid and 3-tert.-butyl-4-hydroxy-5-[benzotriazol-2-yl]-benzenesulfonic acid.

(c) Compounds from the class of sterically hindered amines, for example a 2,2,6,6-tetraalkylpiperidine derivative which, in its molecule, contains at least one group of the formula (9)

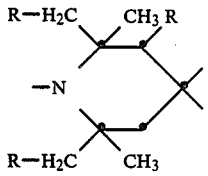

(9)

in which R is hydrogen or methyl.

The light stabilizer can contain one or more such groups of the formula (9), for example it can be a mono-, bis-, tris-, tetra- or oligo-piperidine compound. Piperidine derivatives which contain one or more groups of the formula (9) in which R is hydrogen, and those in which the ring nitrogen does not carry a hydrogen atom, are preferred.

Most of these piperidine light stabilizers carry polar substituents in the 4-position of the piperidine ring.

The following classes of piperidine compounds are of particular importance:

(aa) Compounds of the formula (10)

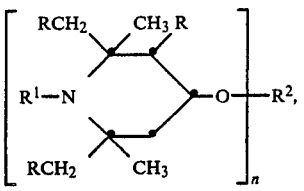

(10)

in which n is a number from 1 to 4, preferably 1 or 2, R is hydrogen or methyl, $R^1$ is hydrogen, oxyl, $C_1$–$C_{18}$-alkyl, $C_3$–$C_8$-alkenyl, $C_3$–$C_8$-alkynyl, $C_7$–$C_{12}$-aralkyl, $C_1$–$C_8$-alkanoyl, $C_3$–$C_5$-alkenoyl, glycidyl or a group —$CH_2CH(OH)$—Z, wherein Z is hydrogen, methyl or phenyl, $R^1$ preferably being $C_1$–$C_{12}$-alkyl, allyl, benzyl, acetyl or acryloyl, and $R^2$, if n is 1, is hydrogen, $C_1$–$C_{18}$-alkyl which may be interrupted by one or more oxygen atoms, cyanoethyl, benzyl, glycidyl, a monovalent radical of an aliphatic, cycloaliphatic, araliphatic, unsaturated or aromatic carboxylic acid, carbamic acid or phosphorus-containing acid or a monovalent silyl radical, preferably a radical of an aliphatic carboxylic acid having 2 to 18 carbon atoms, a cycloaliphatic carboxylic acid having 7 to 15 carbon atoms, an $\alpha,\beta$-unsaturated carboxylic acid having 3 to 5 carbon atoms or an aromatic carboxylic acid having 7 to 15 carbon atoms, or, if n is 2, $R^2$ is $C_1$–$C_{12}$-alkylene, $C_4$–$C_{12}$-alkenylene, xylylene, a divalent radical of an aliphatic, cycloaliphatic, araliphatic or aromatic dicarboxylic acid, dicarbamic acid or phosphorus-containing acid or a divalent silyl radical, preferably a radical of an aliphatic dicarboxylic acid having 2 to 36 carbon atoms, a cycloaliphatic or aromatic dicarboxylic acid having 8–14 carbon atoms or an aliphatic, cycloaliphatic or aromatic dicarbamic acid having 8–14 carbon atoms, or, if n is 3, $R^2$ is a trivalent radical of an aliphatic, cycloaliphatic or aromatic tricarboxylic acid, an aromatic tricarbamic acid or a phosphorus-containing acid or a trivalent silyl radical, and, if n is 4, $R^2$ is a tetravalent radical of an aliphatic, cycloaliphatic or aromatic tetracarboxylic acid.

Any $C_1$–$C_{12}$-alkyl substituents are, for example, methyl, ethyl, n-propyl, n-butyl, sec.-butyl, tert.-butyl, n-hexyl, n-octyl, 2-ethylhexyl, n-nonyl, n-decyl, n-undecyl or n-dodecyl.

$C_1$–$C_{18}$-alkyl $R^1$ or $R^2$ can, for example, be one of the groups listed above and in addition also, for example, n-tridecyl, n-tetradecyl, n-hexadecyl or n-octadecyl.

$C_3$–$C_8$-alkenyl $R^1$ can, for example, be 1-propenyl, allyl, methally, 2-butenyl, 2-pentenyl, 2-hexenyl, 2-octenyl or 4-tert.-butyl-2-butenyl.

$C_3$–$C_8$-alkynyl $R^1$ is preferably propargyl.

$C_7$–$C_{12}$-aralkyl $R^1$ is in particular phenethyl or especially benzyl.

$C_1$–$C_8$-alkanoyl $R^1$ is, for example, formyl, propionyl, butyryl, octanoyl and preferably acetyl, and $C_3$–$C_5$-alkenoyl $R^1$ is especially acryloyl.

A monovalent carboxylic acid radical $R^2$ is, for example, an acetic acid, capronic acid, stearic acid, acrylic acid, methacrylic acid, benzoic acid or $\beta$-(3,5-di-tert.-butyl-4-hydroxyphenyl)-propionic acid radical.

A divalent dicarboxylic acid radical $R^2$ is, for example, a malonic acid, adipic acid, suberic acid, sebacic acid, maleic acid, phthalic acid, dibutylmalonic acid, dibenzylmalonic acid, butyl-(3,5-di-tert.-butyl-4-hydroxybenzyl)-malonic acid or bicycloheptenedicarboxylic acid radical.

A trivalent tricarboxylic acid radical $R^2$ is, for example, a trimellitic acid or nitrilotriacetic acid radical.

A tetravalent tetracarboxylic acid radical $R^2$ is, for example, the tetravalent radical of butane-1,2,3,4-tetracarboxylic acid or of pyromellitic acid.

A divalent dicarbamic acid radical $R^2$ is, for exmaple, a hexamethylenedicarbamic acid or 2,4-toluylenedicarbamic acid radical.

Examples of tetraalkylpiperidine compounds of this class are the following compounds:

(1) 4-Hydroxy-2,2,6,6-tetramethylpiperidine
(2) 1-Allyl-4-hydroxy-2,2,6,6-tetramethylpiperidine
(3) 1-Benzyl-4-hydroxy-2,2,6,6-tetramethylpiperidine
(4) 1-(4-tert.-Butyl-2-butenyl)-4-hydroxy-2,2,6,6-tetramethylpiperidine
(5) 4-Stearoyloxy-2,2,6,6-tetramethylpiperidine
(6) 1-Ethyl-4-salicyloyloxy-2,2,6,6-tetramethylpiperidine
(7) 4-Methacryloyloxy-1,2,2,6,6-pentamethylpiperidine
(8) 1,2,2,6,6-Pentamethylpiperid-4-yl $\beta$-(3,5-di-tert.-butyl-4-hydroxyphenyl)-propionate
(9) Di-(1-benzyl-2,2,6,6-tetramethylpiperid-4-yl) maleate
(10) Di-(2,2,6,6-tetramethylpiperid-4-yl) adipate
(11) Di-(2,2,6,6-tetramethylpiperid-4-yl) sebacate
(12) Di-(1,2,3,6-tetramethyl-2,6-diethylpiperid-4-yl) sebacate
(13) Di-(1-allyl-2,2,6,6-tetramethylpiperid-4-yl) phthalate
(14) 1-Propargyl-4-$\beta$-cyanoethyloxy-2,2,6,6-tetramethylpiperidine
(15) 1-Acetyl-2,2,6,6-tetramethylpiperid-4-yl acetate
(16) Tri-(2,2,6,6-tetramethylpiperid-4-yl) trimellitate
(17) 1-Acryloyl-4-benzyloxy-2,2,6,6-tetramethylpiperidine
(18) Di-(1,2,2,6,6-pentamethylpiperid-4-yl) dibutylmalonate
(19) Di-(1,2,2,6,6-pentamethylpiperid-4-yl) butyl-(3,5-di-tert.-butyl-4-hydroxybenzyl)-malonate
(20) Di-(1,2,2,6,6-pentamethylpiperid-4-yl) dibenzylmalonate
(21) Di-(1,2,3,6-tetramethyl-2,6-diethylpiperid-4-yl) dibenzylmalonate
(22) Hexane-1',6'-bis-(4-carbamoyloxy-1-n-butyl-2,2,6,6-tetramethylpiperidine)
(23) Toluene-2'-4'-bis-(4-carbamoyloxy-1-n-propyl-2,2,6,6-tetramethylpiperidine)
(24) Dimethyl-bis-(2,2,6,6-tetramethylpiperid-4-yloxy) silane
(25) Phenyl-tris-(2,2,6,6-tetramethylpiperid-4-yloxy) silane
(26) Tris-(1-propyl-2,2,6,6-tetramethylpiperid-4-yl) phosphite
(27) Tris-(1-propyl-2,2,6,6-tetramethylpiperid-4-yl) phosphate
(28) Bis-(1,2,2,6,6-pentamethylpiperid-4-yl) phenylphosphonate
(29) Di-(1,2,2,6,6-pentamethylpiperid-4-yl)sebacate
(30) 4-Hydroxy-1,2,2,6,6-pentamethylpiperidine
(31) 4-Hydroxy-N-hydroxyethyl-2,2,6,6-tetramethylpiperidine
(32) 4-Hydroxy-N-(2-hydroxypropyl)-2,2,6,6-tetramethylpiperidine
(33) 1-Glycidyl-4-hydroxy-2,2,6,6-tetramethylpiperidine (bb) Compounds of the formula (11)

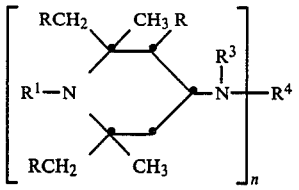

(11)

in which n is the number 1 or 2, R and $R^1$ are as defined under (aa), $R^3$ is hydrogen, $C_1$–$C_{12}$-alkyl, $C_2$–$C_5$-hydroxyalkyl, $C_5$–$C_7$-cycloalkyl, $C_7$–$C_8$-aralkyl, $C_2$–$C_{18}$-alkanoyl $C_3$–$C_5$-alkenoyl or benzoyl and $R^4$, if n is 1, is hydrogen, $C_1$–$C_{18}$-alkyl, $C_3$–$C_8$-alkenyl, $C_5$–$C_7$-cycloalkyl, $C_1$–$C_4$-alkyl which is substituted by a hydroxy, cyano, alkoxycarbonyl or carbamide group, glycidyl, a group of the formula —$CH_2$—CH(OH)—Z or of the formula —CONH—Z, wherein Z is hydrogen, methyl or phenyl, or, if n is 2, $R^4$ is $C_2$–$C_{12}$-alkylene, $C_6$–$C_{12}$-arylene, xylylene, a —$CH_2$—CH(OH)—$CH_2$— group or a group —$CH_2$—CH(OH)—$CH_2$—O—D—O—, wherein D is $C_2$–$C_{10}$-alkylene, $C_6$–$C_{15}$-arylene, $C_6$–$C_{12}$-cycloalkylene or, provided that $R^3$ is not alkanoyl, alkenoyl or benzoyl, $R^4$ can also be a divalent radical of an aliphatic, cycloaliphatic or aromatic dicarboxylic acid or dicarbamic acid or also a group —CO—, or $R^3$ and $R^4$ together can, if n is 1, be a divalent radical of an aliphatic, cycloaliphatic or aromatic 1,2- or 1,3-dicarboxylic acid.

Any $C_1$–$C_{12}$- or $C_1$–$C_{18}$-alkyl substituents are as defined above under (aa).

Any $C_5$–$C_7$-cycloalkyl substituents are especially cyclohexyl.

$C_7$–$C_8$-aralkyl $R^3$ is in particular phenylethyl or especially benzyl. $C_2$–$C_5$-hydroxyalkyl $R^3$ is especially 2-hydroxyethyl or 2-hydroxypropyl.

$C_2$–$C_{18}$-alkanoyl $R^3$ is, for example, propionyl, butyryl, octanoyl, dodecanoyl, hexadecanoyl, octadecanoyl and preferably acetyl, and $C_3$–$C_5$-alkenoyl $R^3$ is especially acryloyl.

$C_2$–$C_8$-alkenyl $R^4$ is, for example, allyl, methallyl, 2-butenyl, 2-pentenyl, 2-hexenyl or 2-octenyl.

$C_1$–$C_4$-alkyl $R^4$ which is substituted by a hydroxyl, cyano, alkoxycarbonyl or carbamide group can be, for example, 2-hydroxyethyl, 2-hydroxypropyl, 2-cyanoethyl, methoxycarbonylmethyl, 2-ethoxycarbonylethyl, 2-aminocarbonylpropyl or 2-(dimethylaminocarbonyl)-ethyl.

Any $C_2$–$C_{12}$-alkylene substituents are, for example, ethylene, propylene, 2,2-dimethylpropylene, tetramethylene, hexamethylene, octamethylene, decamethylene or dodecamethylene.

Any $C_6$–$C_{15}$-arylene substituents are, for example, o-, m- or p-phenylene, 1,4-naphthylene or 4,4'-diphenylene.

$C_6$–$C_{12}$-cycloalkylene D is especially cyclohexylene.

Examples of tetraalkylpiperidine compounds from this class are the following compounds:

(34) N,N'-bis-(2,2,6,6-tetramethylpiperid-4-yl)-hexamethylene-1,6-diamine

(35) N,N'-bis-(2,2,6,6-tetramethylpiperid-4-yl)-hexamethylene-1,6-diacetamide

(36) 1-Acetyl-4-(N-cyclohexylacetamido)-2,2,6,6-tetramethylpiperidine

(37) 4-Benzoylamino-2,2,6,6-tetramethylpiperidine

(38) N,N'-bis-(2,2,6,6-tetramethylpiperid-4-yl)-N,N'-dibutyladipamide

(39) N,N'-bis-(2,2,6,6-tetramethylpiperid-4-yl)-N,N'-dicyclohexyl-2-hydroxypropylene-1,3-diamine

(40) N,N'-bis-(2,2,6,6-tetramethylpiperid-4-yl)-p-xylylenediamine

(41) The compound of the formula

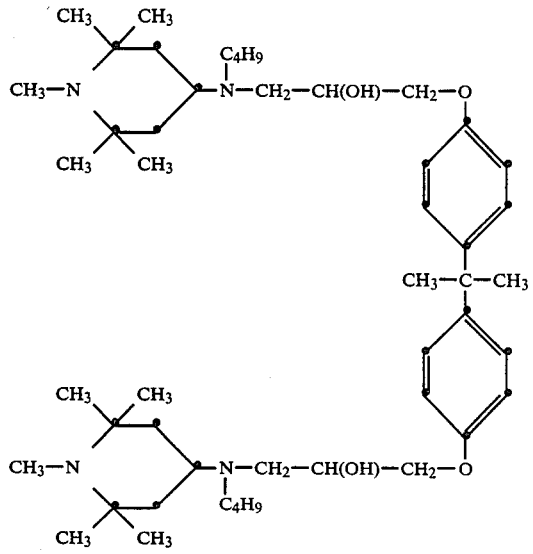

(42) 4-(Bis-2-hydroxyethylamino)-1,2,2,6,6-pentamethylpiperidine

(43) 4-(3-Methyl-4-hydroxy-5-tert.-butylbenzamido)-2,2,6,6-tetramethylpiperidine and

(44) 4-Methacrylamido-1,2,2,6,6-pentamethylpiperidine;

(d) 2-(2'-Hydroxyphenyl)-s-triazines of the formula (12)

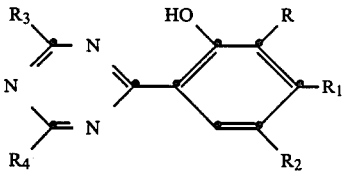

(12)

in which R is hydrogen, halogen, $C_1$–$C_4$-alkyl or sulfo, $R_1$ is hydrogen, $C_1$–$C_4$-alkyl, $C_1$–$C_4$-alkoxy or hydroxyl, $R_2$ is hydrogen or sulfo and $R_3$ and $R_4$ independently of one another are $C_1$–$C_4$-alkyl, $C_1$–$C_4$-alkoxy, $C_5$–$C_6$-cycloalkyl, phenyl or phenyl subsituted by $C_1$–$C_4$-alkyl and hydroxy, it being possible for the sulfo groups to be in the free form or in the form of salts, for example alkali metal, alkaline earth metal, ammonium or amine salts. Examples of compounds of the formula (12) are 2-(2'-4'-dihydroxyphenyl)-4,6-diphenyl-s-triazine, 2-(2'-hydroxy-4'-methoxyphenyl)-4,6-diphenyl-s-triazine, 2-(2'-hydroxy-5'-methylphenyl)-4,6-diphenyl-s-triazine, 2,4-bis-(2'-hydroxy-3'-methylphenyl)-6-ethyl-s-triazine, 2,4-bis-(2'-hydroxyphenyl)-6-methoxy-s-triazine, 2,4-bis-cyclohexyl-6-(2'-hydroxy-4'-methoxyphenyl)-s-triazine and 2-(2'-hydroxy-4'-methoxy-5'-sulfophenyl)-4,6-diphenyl-s-triazine; (compare, for example, WO-A-86/03,528).

(e) s-Triazine compounds of the formula

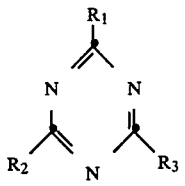

(12a)

in which at least one of the substituents $R_1$, $R_2$ and $R_3$ is a radical of the formula

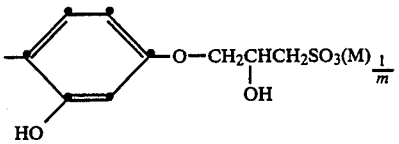

(12b)

in which M is sodium, potassium, calcium, magnesium, ammonium or tetra-$C_1$–$C_4$-alkylammonium and m is 1 or 2, and the remaining substituent or substituents independently of one another are $C_1$–$C_{12}$-alkyl, phenyl, or $C_1$–$C_{12}$-alkyl or phenyl which are bonded to the triazinyl radical via oxygen, sulfur, imino or $C_1$–$C_4$-alkylamino, for example the potassium salt of the compound of the formula (12a), in which $R_1$ is phenyl and $R_2$ and $R_3$ each are the radical of the formula (12b), or the sodium salt of the compound of the formula (12a) in which $R_1$ is p-chlorophenyl and $R_2$ and $R_3$ each are the radical of the formula (12b). Further compounds are described in EP-A-165,608.

As the component (C), the compounds can be used which are described, for example, in Kirk-Othmer (3.), 3, pages 132–135, or in R. Gächter and H. Müller, Taschenbuch der Kunststoff-Additive [Handbook of Plastics Additives], Carl Hanser Verlag, Munich, pages 4–78 (1983).

The component (C) can represent sterically hindered phenols, for example hydroxyphenylpropionates of the formula (13)

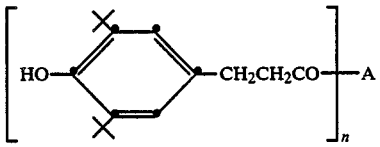

(13)

in which n is an integer from 1 to 4 and A is $C_1$–$C_{24}$-alkoxy, a bridge member $—O(CH_2)_6O—$, $—O(CH_2)_2O(CH_2)_2O—$, $—O(CH_2)_2O(CH_2)_2O(CH_2)_2O—$, $—HN—(CH_2)_{2-6}—NH—$ or $—O(CH_2)_2—S—(CH_2)_2O—$ or the radical $-(CH_2O)_4—C$, for example the esters of 3-(3'-5'-ditert.butyl-4-hydroxyphenyl)-propionic acid with methanol, octadecanol, 1,6-hexanediol, diethylene glycol, triethylene glycol or pentaerythritol, or the diamides of 3-(3'-5'-di-tert.butyl-4-hydroxyphenyl)-propionic acid with ethylenediamine, trimethylenediamine or hexamethylenediamine and phenylalkylphosphonates of the formula (14)

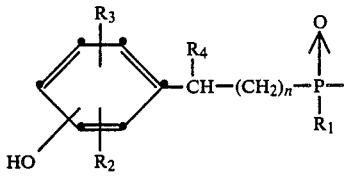

(14)

in which R is hydroxy, phenyl, phenoxy, $C_1$–$C_{18}$-alkylphenoxy, $C_1$–$C_{24}$-alkylthio or $C_1$–$C_{24}$-alkoxy, $R_1$ is phenoxy, $C_1$–$C_{18}$-alkylphenoxy, $C_1$–$C_{24}$-alkylthio or $C_1$–$C_{24}$-alkoxy, $R_2$ and $R_3$ independently of one another are $C_1$–$C_{18}$- and preferably $C_1$–$C_6$-alkyl and especially tert.-butyl in the 3- and 5-positions, $R_4$ is hydrogen or $C_1$–$C_4$-alkyl and n is 0, 1, 2 or 3, preferably 0 or 1, for example di-n-octadecyl 3-tert.butyl-4-hydroxy-5-methylbenzylphosphonate, di-n-octadecyl 1-(3',5'-di-tert.butyl-4'-hydroxyphenyl)-ethanephosphonate, di-n-octadecyl 3,5-di-tert.butyl-2-hydroxybenzylphosphonate, di-n-dodecyl 2-(3',5'-di-tert.butyl-4'-hydroxyphenyl)-ethanephosphonate, diethyl 3,5-di-tert.butyl-4-hydroxybenzylphosphonate, dimethyl 3,5-di-tert.butyl-4-hydroxybenzylphosphonate, di-p-tert.-octylphenyl 3,5-di-tert.butyl-4-hydroxybenzylphosphonate, O-n-butyl 3,5-di-tert.butyl-4-hydroxybenzylphosphonate, di-n-butyl 3,5-di-tert.butyl-4-hydroxybenzylphosphonate and O-ethyl 3,5-di-tert.butyl-4-hydroxybenzylphosphonic acid.

The compounds listed above which can be used as the components (A), (B) and (C) are known and can be prepared by processes known per se.

The compounds of the formulae (1) to (6) are known, for example, from EP-A 51,188, 113,856 and 162,811 and can be prepared by known processes.

The compounds of the formulae (7) and (8) can be prepared by processes known per se, such as are described in, for example, U.S. Pat. Nos. 3,403,183 and 4,127,586 respectively. Compounds of the formula (8) in which $R_1$, $R_2$, $R_3$ and/or $R_4$ are sulfo can be prepared by the process described in EP-A-112,120.

Compounds of the formula (8) in which $R_1$ is $C_1$–$C_{12}$- and preferably $C_1$–$C_4$-alkyl and $R_3$ is sulfo can also be prepared by sulfonating the corresponding compound, in which $R_3$ is $C_1$–$C_{12}$- and preferably $C_1$–$C_4$-alkyl, with oleum, preferably 25% oleum, at temperatures between 10° and 30° C. and neutralizing the product obtained to pH 7.

The preparation of the compounds from the class of sterically hindered amines of the formulae (9) to (11) is described, for example, in U.S. Pat. Nos. 3,640,928, 3,840,494 and 3,993,655.

The compounds of the formula (12) can be prepared in a manner known per se, for example by the processes described in Helv. 55, 1566–1595 (1972) and in WO 86/03,528.

The preparation of compounds of the formula (13) can be carried out in a manner known per se, as described, for example, in GB-A-1,103,144.

The compounds of the formula (14) can be prepared in a manner known per se, for example by the processes described in U.S. Pat. No. 3,268,630.

The agents according to the invention are appropriately applied from an aqueous bath and advantageously employed in such a quantity that there are 5 to 200 μg, especially 10 to 100 μg, of copper metal per 1 g of polyamide. They contain, therefore, (a) 0.005 to 0.2% by weight of an organic copper complex, (b) 0.05 to 3, preferably 0.1 to 1% by weight of a light stabilizer and, if appropriate, (c) 0.05 to 3, and preferably 0.1 to 1% by weight of an antioxidant.

The agents according to the invention, to which the present invention also relates, are used for stabilizing dyed material before, during or after dyeing. Advantageously, the agent is added directly to the dyebath. Dyeing is carried out continously or discontinuously.

Appropriately, the agents according to the invention—if they are water-insoluble—are used as fine dispersions which are obtained by grinding in the presence of conventional dispersing agents.

Polyamide material is to be understood as meaning a synthetic polyamide, for example polyamide 6, polyamide 6,6 or polyamide 12. In addition to pure polyamide fibres, they can also be especially fibre blends of polyurethane and polyamide, for example a tricot material of polyamide/polyurethane in a 70:30 blending ratio. In principle, the pure or blended polyamide material can be in the most diverse processing forms, for example as fibre, yarn, woven fabric or knitted fabric.

Especially polyamide material which is exposed to light and heat and is, for example, in the form of car upholstery material or carpets is very particularly suitable for being treated by the present process.

Dyeing is carried out in the conventional manner, for example with metal complex dyes, anthraquinone dyes or azo dyes. The metal complex dyes used are the known types, especially the 1:2 chromium or 1:2 cobalt complexes of monoazo or disazo or azomethine dyes, a large number of which are described in the literature. Apart from these, dyes from other classes of dyes are of course also possible, for example disperse or even vat dyes.

The examples which follow serve to illustrate the invention. Parts are parts by weight and percentages are percent by weight. The percentage data concerning the additions to the individual treatment or dyebaths relate to the fibre material, unless otherwise stated.

EXAMPLE 1

Improvement of the Light Stability and Light Fastness of an Olive Dyeing

Four yarn hanks of 10 g each of polyamide 66 staple yarn are treated in a dyeing apparatus with liquors (1:20 liquor ratio) which generally contain 1 g/l of ammonium sulfate (pH 6.5) and the following dyes (calculated on the yarn)

0.05% of dye 1

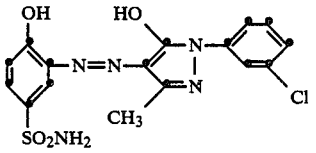

1:2 Co complex (yellow)

0.25% of dye 2

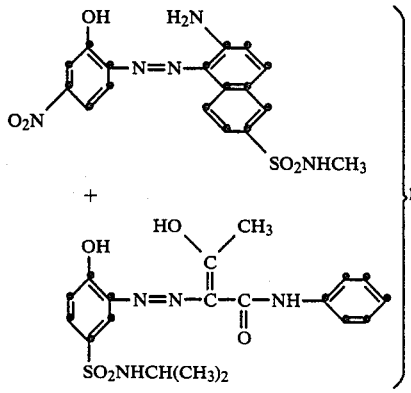

1:2 Co complex (green)

-continued 0.035% of dye 3

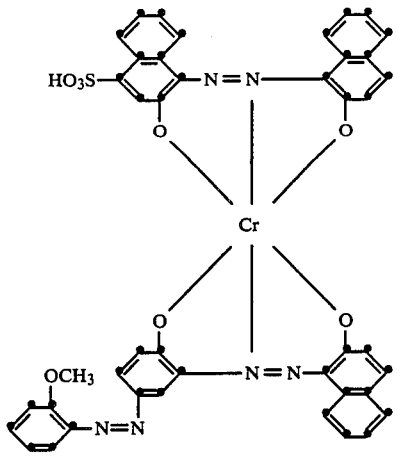

1:2 Cr complex (black)

The compounds are added in the dissolved form to the dyebath.

Dye liquor 1: no further additions.

Dye liquor 2: 0.04% of the copper complex of the formula

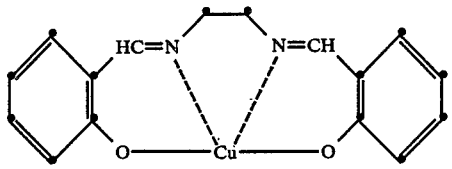

(100)

in finely dispersed form (particle size <2 μm); ground with the condensation product of naphthalenesulfonic acid and formaldehyde as a dispersing agent in a 1:1 weight ratio; aqueous dispersion Dye liquor 3: 1% of the light stabilizer of the formula

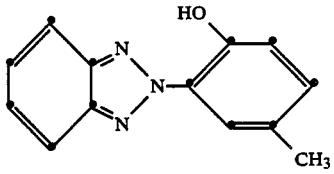

(101)

in finely dispersed form (particle size <2 μm); ground with the condensation product of naphthalenesulfonic acid and formaldehyde as a dispersing agent in a 1:1 weight ratio.

Dye liquor 4: the additives of dye liquors 2 and 3 combined.

The materials to be dyed are introduced into the liquors prepared as described, treated for 5 minutes at 40° C. and heated at a rate of 1.5° C./minute to 95° C. They are left for 60 minutes at this temperature, the dyebath is then cooled to 70° C., and the dyeings are rinsed in cold water, centrifuged and dried at 80° C. in a circulating-air oven.

The dyeings are then tested as follows:

(a) Light fastness:

Xenon light according to Swiss Standard [Swiss Norm] SN-ISO 105-B02

Fakra light according to DIN 75,202 (hot exposure)

(b) Photostability:

The polyamide staple yarn is wound up on cardboard and exposed for 750 hours under xenon light or 120 hours under Fakra light conditions. The yarn is then tested in accordance with SNV (Schweizerische Normen-Vereinigung) [Swiss Standards Association] standard 197,461 for its tensile strength and elongation. The following results are obtained, the tensile strength and elongation of unexposed and untreated polyamide 66 staple yarn being set at 100%.

TABLE 1

| Dye liquor | Light fastness xenon | Light fastness Fakra | Tensile strength/elongation in % After 120 hours exposure under Fakra light | Tensile strength/elongation in % After 750 hours exposure under xenon light |
|---|---|---|---|---|
| 1 | 6–7 | 5 | 32.6/36 | 49.7/51.2 |
| 2 | 6–7 | 6 | 73.4/67.1 | 69.4/64.2 |
| 3 | −7 | 5 | 31.6/38.9 | 64.5/56.7 |
| 4 | 7 | 7 | 79.4/68.1 | 71.2/61.3 |

The results show that, (a) the copper complex improves the light fastness and photostability under hot exposure, (b) the light stabilizer provides an improvement in light fastness and photostability under xenon exposure and (c) the combination of both compounds improves the light fastness and photostability in both hot exposure and xenon exposure.

EXAMPLE 2

Improvement of the Photostability and Light Fastness of a Beige Dyeing

The dyeing is carried out as described in Example 1, with the difference that the following dye combination is used for dyeing 0.04% of dye 4

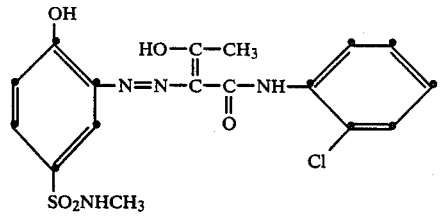

1:2 Co complex (yellow)

0.025% of dye 5

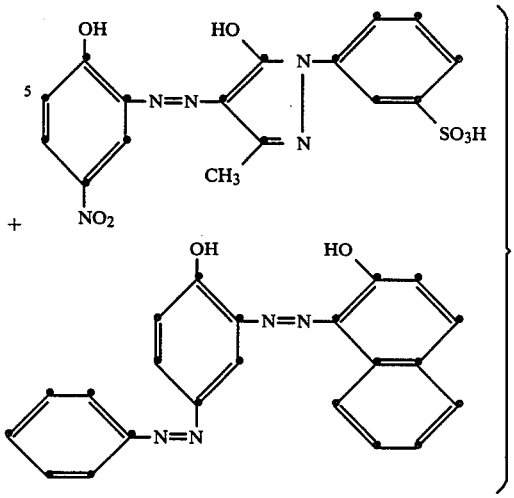

1:2 Cr complex (brown)

0.003% of dye 3 as in Example 1 (black)

The testing of the dyeings was carried out as noted in Example 1.

Dye liquor 5: only dyes 3, 4 and 5

Dye liquor 6: additionally copper complex of the formula (100)

Dye liquor 7: additionally light stabilizer of the formula (101)

Dye liquor 8: additionally combination of the compounds of the formulae (100) and (101).

The results are summarized in the table which follows:

TABLE 2

| Dye liquor | Light fastness xenon | Light fastness Fakra | Tensile strength/elongation in % After 120 hours exposure under Fakra light | Tensile strength/elongation in % After 750 hours exposure under xenon light |
|---|---|---|---|---|
| 5 | 6 | 5 | 24.9/26.6 | 45.8/44.5 |
| 6 | 6 | 6 | 54.4/57.5 | 54.3/55.2 |
| 7 | 6–7 | 5–6 | 33.9/36.1 | 58.5/53.2 |
| 8 | 7 | 6–7 | 65.1/65.5 | 70.8/63.7 |

EXAMPLE 3

Photostabilization and Light Fastness Improvement of a Mouse-Grey Dyeing

The procedure and testing are carried out as described in Example 1, with the following differences:

(a) The following dyes are used in dye liquors 9–12:

0.05% of dye 1 as in Example 1 (yellow)

0.015% of dye 6

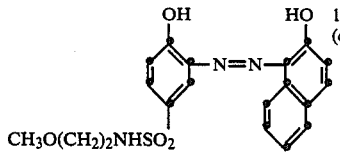

1:2 Co complex (claret)

0.14% of dye 7 81 parts of dye 3 as in Example 1 and 12 parts of the dye (black)

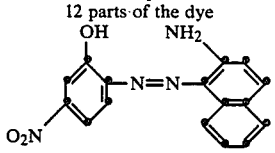

1:2 Co complex (black)

Dye liquor 9 does not contain any further additive. In the liquors 10 and 12, 0.075% of the copper complex of the formula

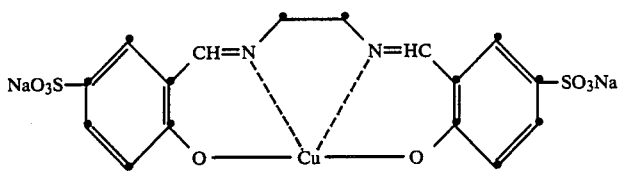

(200)

are used in addition, whereas dye liquors 11 and 12 also contain 1% of the light stabilizer of the formula (101).

(b) After exhaustion of the dye at 95° C., 2% of acetic acid (80%) are also added to all the dyeings 9–12.

The results are summarized in the table which follows:

TABLE 3

| Dye liquor | Light fastness xenon | Light fastness Fakra | Tensile strength/elongation in % After 120 hours exposure under Fakra light | Tensile strength/elongation in % After 750 hours exposure under xenon light |
|---|---|---|---|---|
| 9 | 6 | 5 | 43.9/42 | 56.9/57.5 |
| 10 | 6–7 | 7 | 66.7/66.8 | 64.0/58.3 |
| 11 | 7–8 | 6 | 46.0/46.9 | 56.9/77.1 |
| 12 | 7–8 | 7 | 74.4/66.9 | 68.8/68.3 |

EXAMPLE 4

Improvement in the photostability and Light Fastness of a Grey Dyeing

Three 10 g yarn hanks of polyamide 66 staple yarn are each dyed to a grey shade in the dyeing apparatus, as described in Examples 1 and 3. After the dyeings have been rinsed, the yarn hanks are each aftertreated with one of the liquors described below at 60° C. for 45 minutes at a 1:20 liquor ratio, with the addition of 2% of acetic acid (80%).

Liquor 1: no addition

Liquor 2: addition of 0.05%, relative to the weight of material, of the compound of the formula (200).

Liquor 3: addition of, relative to the weight of the material, 0.05% of the compound of the formula (200)

0.25% of the compound of the formula

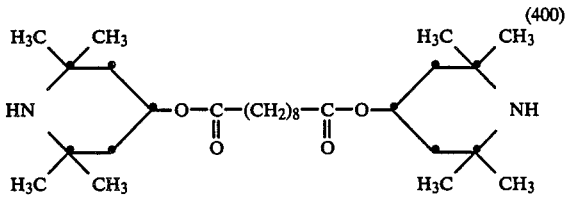

(400)

0.25% of the compound of the formula

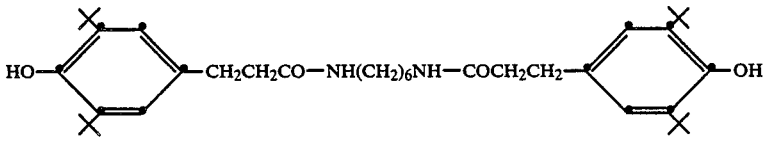

(401)

The compounds of the formulae (400) and (401) are ground to a particle size of <2 μm in an aqueous solution of the condensation product of naphthalenesulfonic acid and formaldehyde as a dispersing agent, in a 1:1 weight ratio.

The light fastnesses of the dyeings obtained with liquors 2 and 3 are equal, but better than dye 1 by 0.5 points (xenon light) and 2 points (Fakra light). In photochemical stability after exposure in xenon light for 1,000 hours, the yarn hank treated with the liquor 3 shows a tensile strength which is improved by 20% over that of the yarn hank which has been treated with liquor 2 and which still has 50% of the initial strength. The yarn hank treated with liquor 1 only has 20% of the initial strength left.

EXAMPLE 5

12 yarn hanks of 10 g each of polyamide 66 staple yarn are dyed to a light beige shade, using the dye mixture 0.042% of dye 4 according to Example 2

0.016% of dye 6 according to Example 3 and 0.008% of dye 7 according to Example 3, the dyebaths also containing the following additions:

Liquor 1: no addition

Liquor 2: addition of 0.04%, relative to the weight of the material, of the compound of the formula (100)

Liquor 3: addition of 1%, relative to the weight of the material, of the compound of the formula

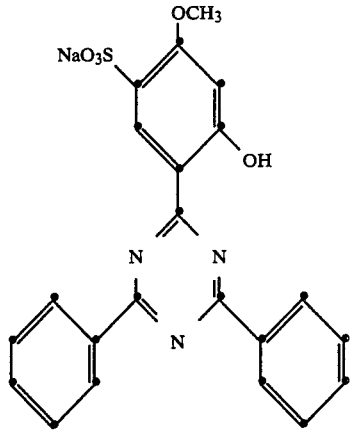

(500)

Liquor 4: addition of 1%, relative to the weight of the material, of the compound of the formula

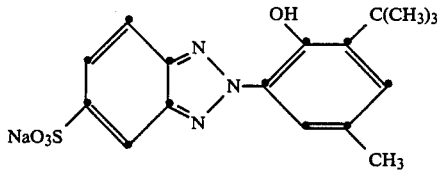

(501)

Liquor 5: addition of 1%, relative to the weight of the material, of the compound of the formula

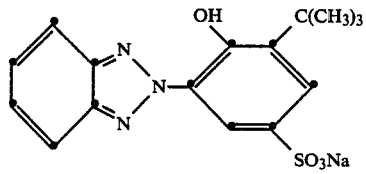

(502)

Liquor 6: addition of 1%, relative to the weight of the material, of the compound of the formula

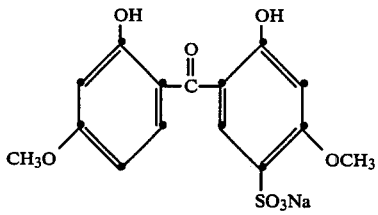

(503)

Liquor 7: addition of 1%, relative to the weight of the material, of the compound of the formula

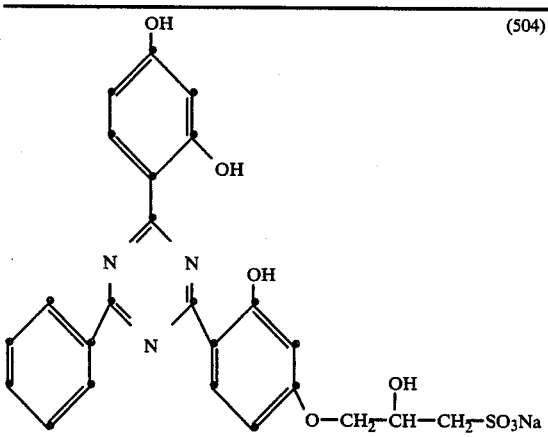

(504)

| Liquor No. | Quantity* added in % | Compound No. |
|---|---|---|
| 8 | 0.04 | (100) |
| | 1.00 | (500) |
| 9 | 0.04 | (100) |
| | 1.00 | (501) |
| 10 | 0.04 | (100) |
| | 1.00 | (502) |
| 11 | 0.04 | (100) |
| | 1.00 | (503) |
| 12 | 0.04 | (100) |
| | 1.00 | (504) |

*of the active substances, relative to the weight of the material

The 12 yarn hanks are dyed as described in Example 1, with the difference that 2% of acetic acid (80%) are also added to the dyebath at 95° C., after a dyeing time of 20 minutes.

The dyeings are then tested for light fastnesses by SN-ISO105-B02 (=xenon light), DIN 75,202 provisional (Fakra) and FORD EU-BO 50-2 (=Ford) and for light stability. To determine the latter, the yarn is exposed for 150 hours under Fakra light and then examined according to SNV 197,461 for tensile strength and elongation.

The results are summarized in the table which follows:

TABLE 4

| Dyeing from liquor | Light fastness XENON | FAKRA | FORD | Tensile strength/elongation [%] after 150 hours Fakra exposure |
|---|---|---|---|---|
| 1 | 5 | <4 | 2-3 H | 17.4/17.1 |
| 2 | 5-6 | 6 | −3-4 H | 70.6/59.6 |
| 3 | 6-7 | 4+ | 4-5 | 27.4/27.5 |
| 4 | 6-7 | 4-5 | 4+ | 35.7/29.5 |
| 5 | 6-7 | 4-5 | 4-5 | 36.4/33.4 |
| 6 | 6 | 4-5 | 3-4 | 30.2/29.8 |
| 7 | 6-7 | 5 | 4-5 | 40.0/39.6 |
| 8 | 6-7 | 6-7 | −5 | 73.9/69.6 |
| 9 | 6-7 | 7 | 4-5 | 78.6/69.8 |
| 10 | 7 | 7 | −5 | 79.9/69.4 |
| 11 | 6-7 | 6-7 | 4 | 72.8/69.2 |
| 12 | 7 | 7 | 4-5 | 71.6/65.9 |

It can be seen from the table that the Cu complex improves especially the fibre stability and also the Fakra light fastness, whereas the UV absorber assists in improving the light fastness according to xenon and especially according to Ford (radiation with a high proportion of UV light).

Preparation of the Compound of the Formula (502)

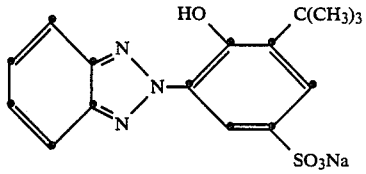

80.9 of 2-(2'-hydroxy-3',5'-di-tert.butylphenyl)benzotriazole are introduced within one hour at 15°-20° C. into 150 ml of 25% oleum. A solution is formed which is stirred for a further 16 hours at room temperature. The solution is then allowed to run with vigorous stirring into a mixture of 600 g of ice and 400 ml of water. The product which has precipitated is heated to 80° C. and, after cooling to room temperature, filtered off. The acid is thoroughly squeezed off and then suspended in 1 liter of water. The suspension is then neutralized (pH 7) with 30% sodium hydroxide solution within 1½ hours, with stirring. The thick crystal paste which has precipitated is then heated to 80° C. once more, a crystal form resulting which can readily be filtered, and is filtered off after cooling to room temperature. The crystals are dried at 100° C. in vacuo. Yield: 83.5 g. The product can be recrystallized from ethanol/water in a ratio of 8:2.

EXAMPLE 6

10 pieces of 10 g of a high-matt polyamide 6 tricot material are dyed with the olive dye mixture of Example 1 as indicated there, the following additions being made to the dyebaths, including 2% of acetic acid (80%) after a dyeing time of 20 minutes at 95° C.

Liquor 1: no addition

Liquor 2: additions of 1%, relative to the weight of the material, of compound (500)

Liquor 3: additions of 0.03%, relative to the weight of the material, of the compound of the formula

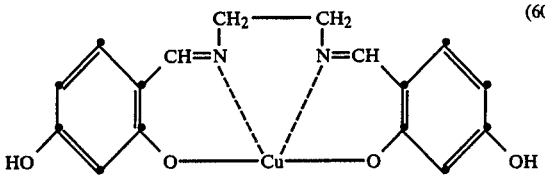

(600)

(preparation of the finely dispersed form as for compound (100)).

Liquor 4: addition of 0.06%, relative to the weight of the material, of the compound of the formula

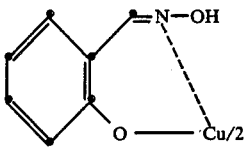

(601)

(preparation of the finely dispersed form as for compound (100)).

Liquor 5: addition of 0.06%, relative to the weight of the material, of the compound of the formula

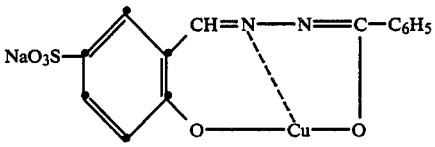

(602)

Liquor 6: addition of 0.06%, relative to the weight of the material, of the compound of the formula

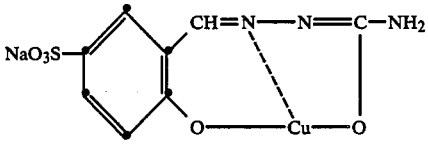

(603)

| Liquor No. | Quantity added in %* | Compound No. |
|---|---|---|
| 7 | 1.00 | (501) |
| | 0.03 | (600) |
| 8 | 1.00 | (501) |
| | 0.06 | (601) |
| 9 | 1.00 | (501) |
| | 0.06 | (602) |
| 10 | 1.00 | (501) |
| | 0.06 | (603) |

The light fastnesses of the dyeings are determined according to DIN 75,202 provisional (Fakra). They are summarized in the table which follows:

TABLE 5

| Dyeing from liquor | Light fastness according to Fakra |
|---|---|
| 1 | <4 |
| 2 | 4–5 |
| 3 | 6 |
| 4 | 6 |
| 5 | −6 |
| 6 | 5–6 |
| 7 | 6–7 |
| 8 | 6–7 |
| 9 | 6–7 |
| 10 | 6+ |

EXAMPLE 7

5 yarn hanks of 10 g each of a polyamide 6 carpet yarn are dyed in a dyeing apparatus at a 1:30 liquor ratio with 1% of acetic acid (80%) and 1%, relative to the weight of the material, of the dye 8 of the formula

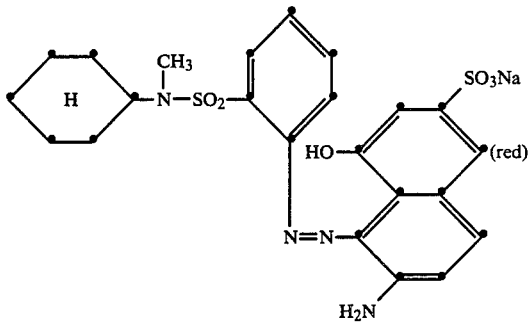

by introducing the yarn at 50° C., treating for 5 minutes at this temperature, then heating to 85° C. within 20 minutes, adding a further 1% of acetic acid (80%), dyeing for 30 minutes, cooling, rinsing the dyeing in cold water and drying, the liquors also containing the following additions Liquor 1: no additions Liquor 2: 0.04%, relative to the weight of the material, of compound (600) in a finely dispersed form, Liquor 3: 1.5%, relative to the weight of the material, of compound (700):

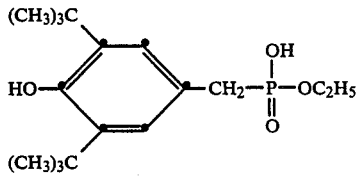

in solution,

Liquor 4: 1.5%, relative to the weight of the material, of compound (700), 0.04%, relative to the weight of the material, of compound (600) in a finely dispersed form.

The dyed yarn is tested for its light fastness (xenon light, Fakra) and exposed for 100 hours under Fakra and for 1,000 hours under xenon and tested for its tensile strength and elongation.

The results are summarized in the table which follows:

TABLE 6

| Dyeing from liquor | Light fastness XENON | Light fastness FAKRA | Tensile strength/elongation [%] after 100 hours Fakra | Tensile strength/elongation [%] After 1,000 hours xenon |
|---|---|---|---|---|
| 1 | 6 | <4 | 35.0/28.0 | 51.6/56.8 |
| 2 | 6 | 5 | 75.4/64.2 | 67.7/72.1 |
| 3 | 7 | 7 | 52.7/49.8 | 56.9/59.4 |
| 4 | 7 | 7 | 82.6/68.4 | 72.6/75.2 |
| Blank treatment of the yarn | — | — | 26.6/25.7 | 48.2/52.1 |

The results show that the Cu complex—especially in the case of hot exposure—very clearly inhibits the photochemical fibre degradation, whereas the antioxidant counteracts destruction of the dye; as can be seen, especially the Fakra light fastness is improved, the protection of dye and fibre against photochemical degradation is very markedly enhanced by the combination of the two stabilizers.

What we claim is:

1. A process for the photochemical stabilization of undyed and dyed polyamide fiber material or blends thereof with other fiber material, which comprises treating the fiber material with a mixture of (A) a non-dyeing copper complex of an alkylene bisazomethine, cycloalkylene bisazomethine, acylhydrazone, semicarbazone or thiosemicarbazone of an aromatic aldehyde or ketone, or an oxime, (B) a light stabilizer and, if desired, (C) an antioxidant.

2. A process according to claim 1, wherein the components (A) used is a copper complex of the formula (1)

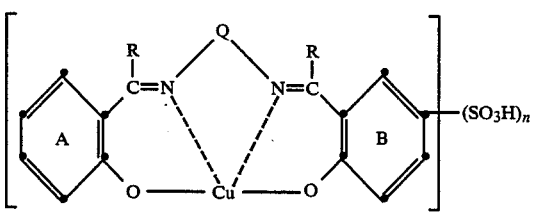

(1)

in which R is hydrogen or a substituted or unsubstituted alkyl or aryl radical, Q is a substituted or unsubstituted alkylene or cycloalkylene radical and n is 0, 1, 2 or 3, and the benzene rings A and B can be substituted independently of one another.

3. A process according to claim 2, wherein the component (A) used is a bisazomethine complex of the formula (2)

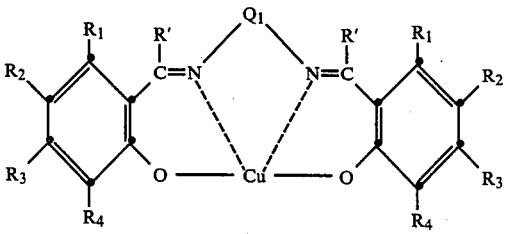

(2)

in which

R' is hydrogen, or $C_1$–$C_3$-alkyl, $R_1$, $R_2$, $R_3$ and $R_4$ are each hydrogen, halogen, hydroxy, hydroxyalkyl, alkyl, alkoxy, alkoxyalkoxy, alkoxyalkoxyalkoxy, carboxymethoxy, alkylamino, dialkylamino, $—SO_2NH_2$, $—SO_2NHR_o$ or $—SO_2N(R_o)_2$, $R_o$ being alkyl or alkoxyalkyl, and alkyl or alkoxy each being understood as meaning groups having 1–4 carbon atoms, or $R_1$ and $R_2$ or $R_2$ and $R_3$ or $R_3$ and $R_4$ together with the carbon atoms, to which they are linked, form a benzene radical, and $Q_1$ is a $C_2$–$C_4$-alkylene radical, a $C_2$–$C_8$-alkylene radical interrupted by a oxygen or nitrogen or a

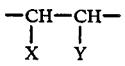

bridge, in which

X and Y each are $C_1$–$C_4$-alkyl or an aromatic radical or X and Y, together with the carbon atoms to which they are linked, form a cycloaliphatic radical having 5–7 carbon atoms.

4. A process according to claim 1, wherein the component (A) used is an acylhydrazone of an aromatic aldehyde or ketone, of the formula (3)

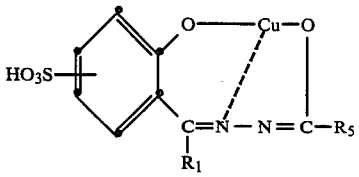

(3)

in which $R_1$ and $R_5$ independently of one another are hydrogen or a substituted or unsubstituted alkyl or aryl radical.

5. A process according to claim 1, wherein the component (A) used is a semicarbazone or thiosemicarbazone of the formula (3a)

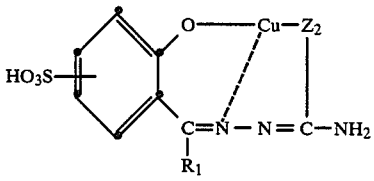

(3a)

in which $R_1$ is hydrogen or a substituted or unsubstituted alkyl or aryl radical and $Z_2$ is oxygen or sulfur.

6. A process according to claim 1, wherein the component (A) used is a copper compound of a phenol of the formula (4)

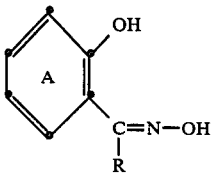

(4)

where R is H, OH, alkyl or cycloalkyl, and in which the ring A may be substituted further.

7. A process according to claim 3, wherein the component (A) used is a bisazomethine complex of the formula (5)

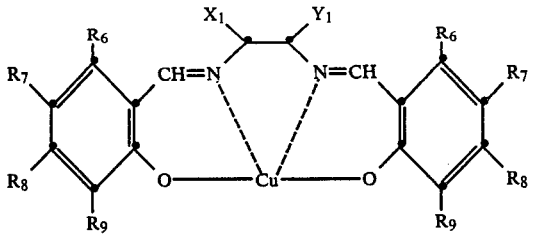

(5)

in which $R_6$, $R_7$, $R_8$ and $R_9$ are each hydrogen, hydroxy, chlorine, bromine, methyl, tert.butyl, methoxy, methoxyethoxy, ethoxyethoxyethoxy or diethylamino and $R_7$ can in addition also be sulfo, $X_1$ is hydrogen, methyl, ethyl or phenyl and $Y_1$ is hydrogen, or $R_6$ and $R_7$ together form a benzene radical or $X_1$ and $Y_1$ together form a cyclohexylene radical.

8. A process according to claim 7, wherein the component (A) used is a bisazomethine complex of the formula (6)

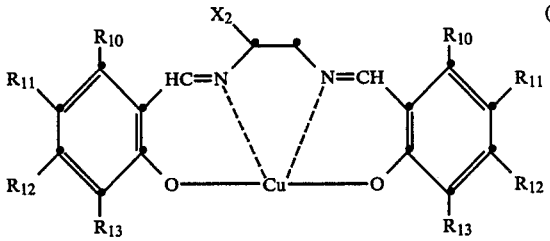

(6)

in which $R_{10}$, $R_{11}$ and $R_{13}$ are each hydrogen, chlorine, bromine, methyl or methoxy and $R_{11}$ can in addition also be sulfo, or $R_{10}$ and $R_{11}$ together form a benzene ring, $R_{12}$ is hydrogen or hydroxy and $X_2$ is hydrogen, methyl, ethyl or phenyl.

9. A process according to claim 1, the component (B) used is a 2-hydroxybenzophenone of the formula (7)

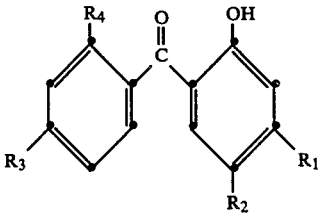

(7)

in which $R_1$ is hydrogen, hydroxy or $C_1$–$C_{14}$alkoxy $R_2$ is hydrogen, $C_1$–$C_4$-alkyl or sulfo, $R_3$ is hydrogen, hydroxy or $C_1$–$C_4$-alkoxy and $R_4$ is hydrogen, hydroxy or carboxy.

10. A process according to claim 1, wherein the component (B) used is a 2-(2'-hydroxyphenyl)-benzotriazole or a salt thereof, of the formula (8)

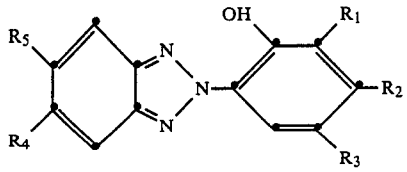

(8)

in which $R_1$ is hydrogen, $C_1$–$C_{12}$-alkyl, chlorine, $C_5$–$C_6$-cycloalkyl, $C_7$–$C_9$-phenylalkyl or sulfo, $R_2$ is hydrogen, $C_1$–$C_4$-alkyl, $C_1$–$C_4$-alkoxy, chlorine, hydroxy or sulfo, $R_3$ is $C_1$–$C_{12}$-alkyl, $C_1$–$C_4$-alkoxy, phenyl, ($C_1$–$C_8$-alkyl)phenyl, $C_5$–$C_6$-cycloalkyl, $C_2$–$C_9$-alkoxycarbonyl, chlorine, carboxyethyl, $C_7$–$C_9$-phenylalkyl or sulfo, $R_4$ is hydrogen, chlorine, $C_1$–$C_4$-alkyl, $C_1$–$C_4$-alkoxy, $C_2$–$C_9$-alkoxycarbonyl, carboxy or sulfo and $R_5$ is hydrogen or chlorine.

11. A process according to claim 1, wherein the component (B) is a 2,2,6,6-tetraalkylpiperidine derivative which, in its molecule, contains at least one group of the formula (9)

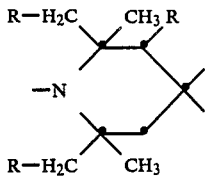

(9)

in which R is hydrogen or methyl.

12. A process according to claim 1, wherein the component (B) used is a 2-(2'-hydroxyphenyl)-s-triazine or a salt thereof, of the formula (12)

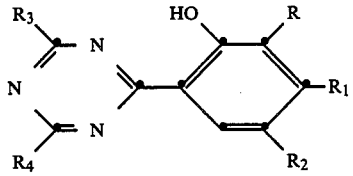

(12)

in which R is hydrogen, halogen, $C_1$–$C_4$-alkyl or sulfo, $R_1$ is hydrogen, $C_1$–$C_4$-alkyl, $C_1$–$C_4$-alkoxy or hydroxy, $R_2$ is hydrogen or sulfo and $R_3$ and $R_4$ independently of one another are $C_1$–$C_4$-alkyl, $C_1$–$C_4$-alkoxy, $C_5$–$C_6$-cycloalkyl phenyl or phenyl substituted by $C_1$–$C_4$-alkyl and hydroxy.

13. A process according to claim 1, wherein the component (B) used is an s-triazine compound of the formula

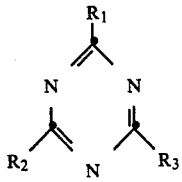

(12a)

in which at least one of the substituents $R_1$, $R_2$ and $R_3$ is a radical of the formula

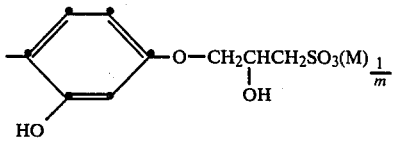

(12b)

in which M is sodium, potassium, calcium, magnesium, ammonium or tetra-$C_1$–$C_4$-alkylammonium and m is 1 or 2, and the remaining substituent or substituents independently of one another are $C_1$–$C_{12}$-alkyl, phenyl, or $C_1$–$C_{12}$-alkyl or phenyl which are bonded to the triazinyl radical via oxygen, sulfur, imino or $C_1$–$C_4$-alkylimino.

14. A process according to claim 1, wherein the component (C) used is a hydroxyphenylpropionate of the formula (13)

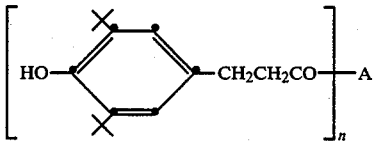

(13)

in which n is an integer from 1 to 4 and A is $C_1$–$C_{24}$-alkoxy, a bridge member —$O(CH_2)_6O$—, —$O(CH_2)_2O(CH_2)_2O$—, —$O(CH_2)_2O(CH_2)_2O(CH_2)_2O$—, —H-N—$(CH_2)_{2-6}$—NH— or —$O(CH_2)_2$—S—$(CH_2)_2O$— or is the radical $(CH_2O)_4$—C.

15. A process according to claim 1, wherein the component (C) used is a phenylalkylphosphonate of the formula (14)

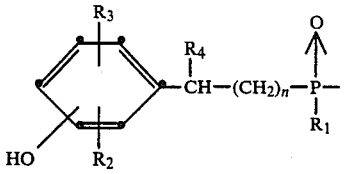

(14)

in which R is hydroxy, phenyl, phenoxy, $C_1$–$C_{18}$-alkylphenoxy, $C_1$–$C_{24}$-alkylthio or $C_1$–$C_{24}$-alkoxy, $R_1$ is phenoxy, $C_1$–$C_{18}$-alkylphenoxy, $C_1$–$C_{24}$-alkylthio or $C_1$–$C_{24}$-alkoxy, $R_2$ and $R_3$ independently of one another are $C_1$–$C_{18}$-alkyl, $R_4$ is hydrogen or $C_1$–$C_4$-alkyl and n is 0, 1, 2 or 3.

16. An agent for the photochemical stabilization of undyed and dyed polyamide fibre material or blends thereof with other fibre materials, which comprises (A) 0.005 to 0.20% by weight of a non-dyeing organic copper complex according to claim 1, (B) 0.05 to 3% by weight of a light stabilizer and, if desired, (C) 0.05 to 3% by weight of an antioxidant.

17. A polyamide fibre material, or blends thereof with other fibre materials, treated by the process according to claim 1.

* * * * *